US005894807A

United States Patent [19]

Aiken

[11] Patent Number: 5,894,807

[45] Date of Patent: Apr. 20, 1999

[54] SAILBOAT

[75] Inventor: Roy E. Aiken, St. Petersburg, Fla.

[73] Assignee: Emergency Contingency Plans, Inc., St. Petersburg, Fla.

[21] Appl. No.: 08/933,259

[22] Filed: Sep. 18, 1997

[51] Int. Cl.[6] ..... B63B 35/00

[52] U.S. Cl. ..... 114/39.1; 114/61; 114/102

[58] Field of Search ..... 114/39.1, 39.2, 114/61, 123, 102, 103

[56] References Cited

U.S. PATENT DOCUMENTS

| | | | |
|---|---|---|---|
| 858,093 | 6/1907 | Mitchell . | |
| 3,509,842 | 5/1970 | Mitchell | 114/61 |
| 3,566,819 | 3/1971 | Keddie | 114/39 |
| 3,648,640 | 3/1972 | Granger | 114/66.5 |
| 3,691,976 | 9/1972 | Wilson | 114/39 |
| 4,192,247 | 3/1980 | Riordan | 114/39 |
| 4,292,910 | 10/1981 | Hoyt | 114/102 |
| 4,294,184 | 10/1981 | Heinrich | 114/61 |
| 4,326,475 | 4/1982 | Berté | 114/39 |
| 4,777,897 | 10/1988 | McKenna | 114/39.1 |
| 4,819,574 | 4/1989 | Westerman | 114/102 |
| 5,134,950 | 8/1992 | Berte | 114/102 |
| 5,228,404 | 7/1993 | Gibbs | 114/61 |
| 5,454,339 | 10/1995 | Hall | 114/39.1 |
| 5,485,799 | 1/1996 | Julien | 114/102 |

*Primary Examiner*—Stephen Avila
*Attorney, Agent, or Firm*—Pettis & Van Royen P.A.

[57] ABSTRACT

A sailboat comprising at least one hull that is connected to a deck that has a line formed in a closed loop connected thereto. A sail, defined as a jib, being attached at its lower corners to the line so that moving the line moves the sail therewith, presenting the sail to the wind as a starboard jib, a spinnaker, or a port jib.

17 Claims, 8 Drawing Sheets

SAILBOAT

BACKGROUND OF THE INVENTION

1. Field of the Invention

This invention relates to the field of sailboats, particularly to sailboat craft having one or more hulls. More particularly, the invention relates to steering control through articulated hulls and positioning of sails in relation to the wind.

2. Description of the Prior Art

The most common apparatus used to control the movement of a sailboat comprises sails and a rudder. The rudder is usually attached to the stern of the sailboat. The angle that the rudder makes with the longitudinal axis of the sailboat is usually controlled directly by a tiller, indirectly by a wheel connected by cables, to a rudder or by other well known means. Sails must be constantly adjusted to present the proper sail angle in relation to the wind as it relates to the particular course to be steered. The adjustment of sails is largely a manual operation. Lines that are attached to the sails or to a boom to which the sail is attached, are tied to various points on the deck holding the sails against the force of the wind. The sails are adjusted to drive the sailboat as efficiently as possible in a particular direction. A sailboat will maintain its heading with its rudder amidships when the sails are in balance. A change in the wind direction will require a change to the sails to keep the sails in balance. To change the heading in which a sailboat is traveling, a change in the position of the rudder is made and the new course is maintained by the rudder until the sails are brought back into balance. Multiple sails are difficult for a lone sailor to efficiently manage.

U.S. Pat. No. 4,292,910 issued to John G. Hoyt, discloses a triangular sail having its head attached to a mast and the two lower points attached to a boom that is pivotally mounted to the bow of a sailing vessel. By pivoting the boom the sail may be presented to the wind at a variety of angles. The boom is unwieldy and difficult for a single sailor to manage.

Multi-hulled craft, such as a trimaran, frequently use a single rudder attached to a central hull, or on the rear hull on a triple hulled vessel utilizing a tetrahedral frame. Some sailboats, such as that disclosed in the patent to McKenna, U.S. Pat. No. 4,777,897 have three separate hulls with a deck suspended therebetween. In this configuration, a single hull, defined as a bow hull, precedes a pair of port and starboard hulls that are spaced apart from one another. The bow hull, having a rudder attached thereto, pivots around a vertical support member to provide steering, but pivots only in the horizontal plane. When a multi-hulled sailboat is in operation, the wind forces on the sail frequently lift one of the rear hulls from the water. If the McKenna 897 sailboat were to ride on one rear hull and the forward steering hull, the hulls will remain fixed to the frame and will tilt as the boat frame tilts, exposing a large portion of the bottom surface of the hulls and wetting a side and even a portion of the top surface of the hulls. The bottom surface of the hulls is designed to efficiently cut through the water and plane on the water surface. When the bottom surface of the hulls lose contact with the water surface in favor of the side of the hulls, the effectiveness of the hulls is reduced. Rudders attached to the stern of multi-hulled vessels become inefficient and often ineffective when the hull to which it is attached rotates longitudinally in the water due to lifting of one of the rear hulls out of the water.

The U.S. Pat. No. 858,093 to Mitchell, discloses a forward hull that rotates about an axis that is horizontal and perpendicular to the longitudinal length of the hull, which allows the forward end of the steering hull of the sailboat to rise to meet oncoming waves. This particular vessel is not designed to ride on the forward steering hull and one of the pair of rear hulls.

In U.S. Pat. No. 3,566,819 issued to James Keddie, when the mast of the vessel is tilted, levers cause the twin hulls to rotate about a longitudinal axis that is parallel to the longitudinal length of the hulls. There is no steering hull disclosed, as the sailboat is steered by a standard rudder mounted on each hull.

Therefore, notwithstanding the existence of such prior art there is a need, particularly on craft with multiple hulls, to provide greater flexibility in steering a sailboat by adjustment of sail and by adjustment of a bow hull with a rudder attached thereto.

SUMMARY OF THE INVENTION

The present invention relates to improvements for sailboats that increase the efficiency and effectiveness of the jib and the rudder in maintaining a predetermined course. The sailboat comprises at least one hull that is connected to a deck that has a bow portion and a stern portion. The first end of a mast is connected to the deck and the second end of the mast extends upwardly therefrom. A first guide is connected to the deck proximal to the bow and pair of guides are connected to the deck proximal to the stern. The pair of guides at the stern are spaced apart from one another. A line having its ends attached to one another forms a loop that tightly but movably engages each of the guides. The head portion of a sail, defined as a jib, is attached to the mast, a first lower corner portion is attached to the line at a first attachment point and a second lower corner portion of the sail is attached to the line at a second attachment point that is spaced apart from the first attachment point. Moving the line through the guides moves the sail therewith, presenting the sail to the wind as a starboard jib, a spinnaker, or a port jib.

BRIEF DESCRIPTION OF THE DRAWINGS

For a fuller understanding of the nature and objects of the invention, reference should be had to the following Detailed Description taken in connection with the accompanying drawings in which:

Similar reference characters refer to similar parts throughout the several views of the drawings. FIG. 8, a second embodiment, utilizes reference numbers increased by increments of 200 for identification of similar parts.

DESCRIPTION OF A PREFERRED EMBODIMENT

A preferred embodiment for the sailboat of this invention is illustrated in FIGS. 1–7 and 9 and 10, and is generally indicated as 10. The sailboat 10 comprises at least one hull shown generally as 12, a deck shown generally as 14, three guides 18*a, b* and *c*, a line 20 and a sail 22. The preferred embodiment illustrated in FIGS. 1–7 and 9 and 10, comprises three hulls, defined as sponsons 12*a*, 12*b* and 12*c*, that are each pivotally connected to the deck 14. The sponsons 12*a–c* are constructed in a manner similar to a surf board, from reinforced high density foam that is encapsulated by a fiber glass coating. Each sponson has a low and wide profile with a slightly convex bottom to allow for a broader more stable riding surface with an adequate displacement of water to give support to the occupants being carried by the sailboat 10. The low profile provides minimum resistance to wave action as the sponsons pass through waves rather than displacing them. The wide convex surface on the bottom allows the sailboat 10 to plane, using the minimum wetted surface necessary to support the vessel and occupant(s) at any given speed and under changing wind conditions. In other embodiments, the sponsons 12*a–c* may be hollow and may be constructed from other well known materials that are suitable for the purpose, including but not limited to metals, plastics and wood.

Figure 1:
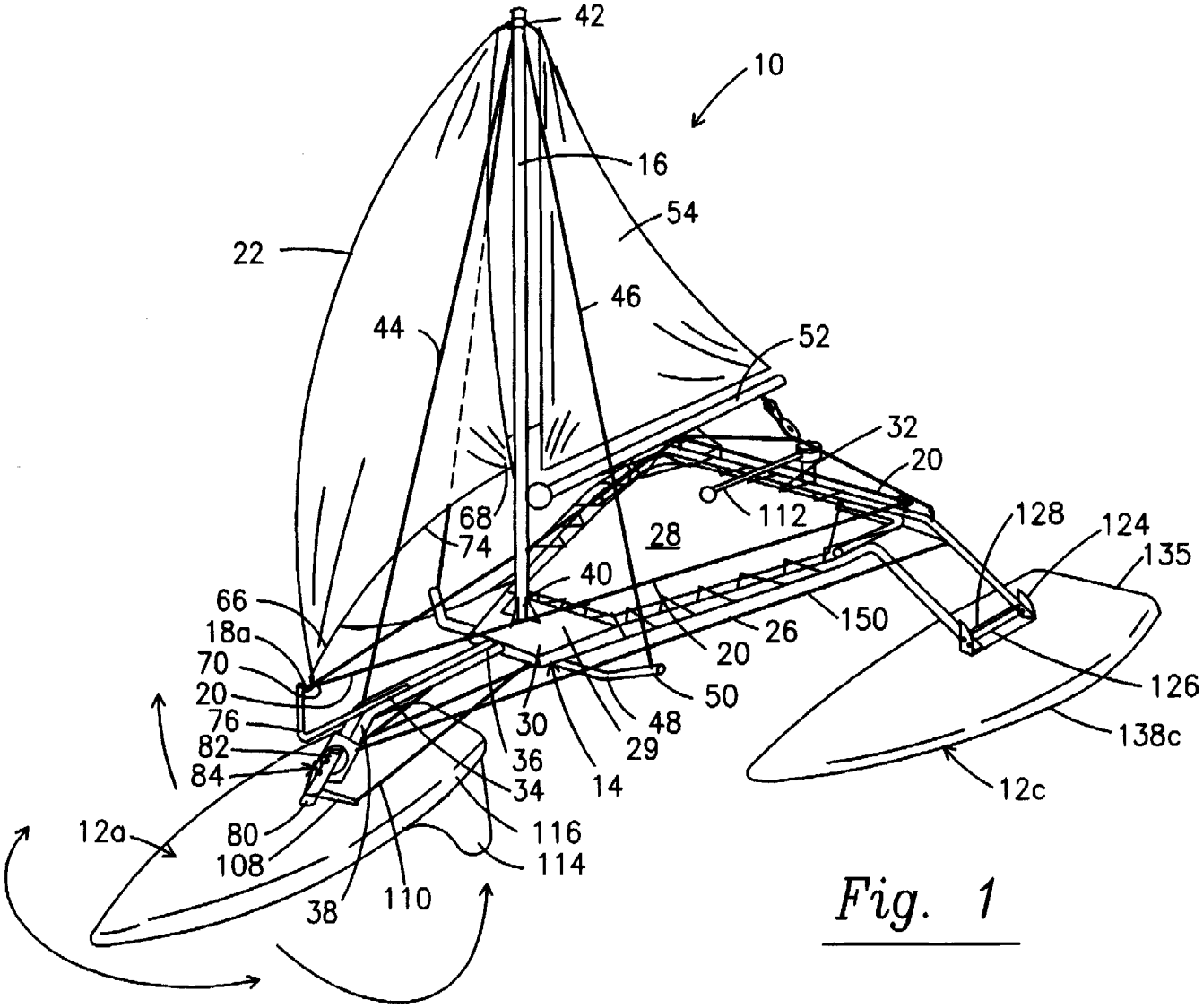
FIG. 1 is an isometric view of the sailboat of this invention.
Figure 2:
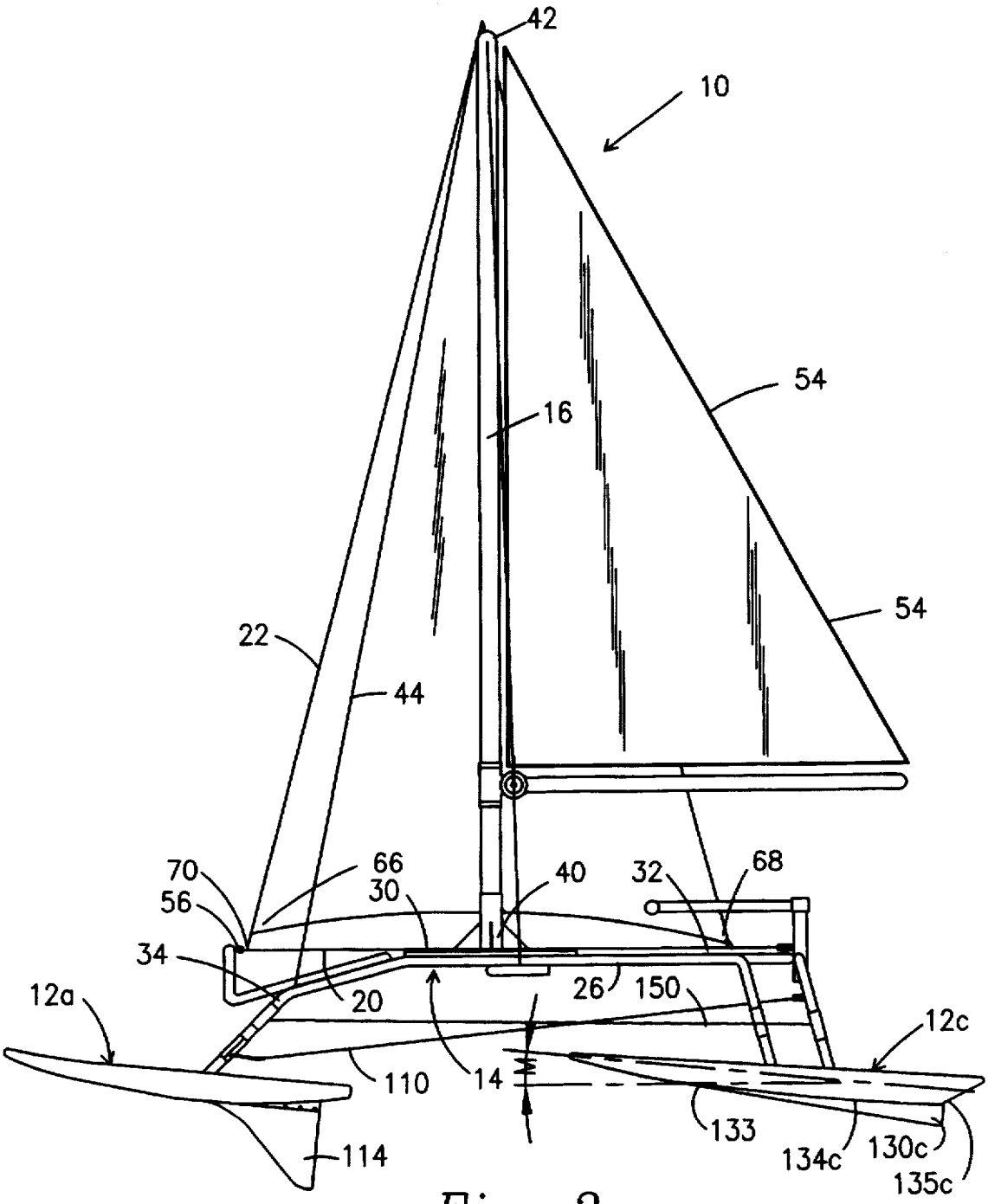
FIG. 2 is a left side elevational view of the invention of FIG. 1.
Figure 5:
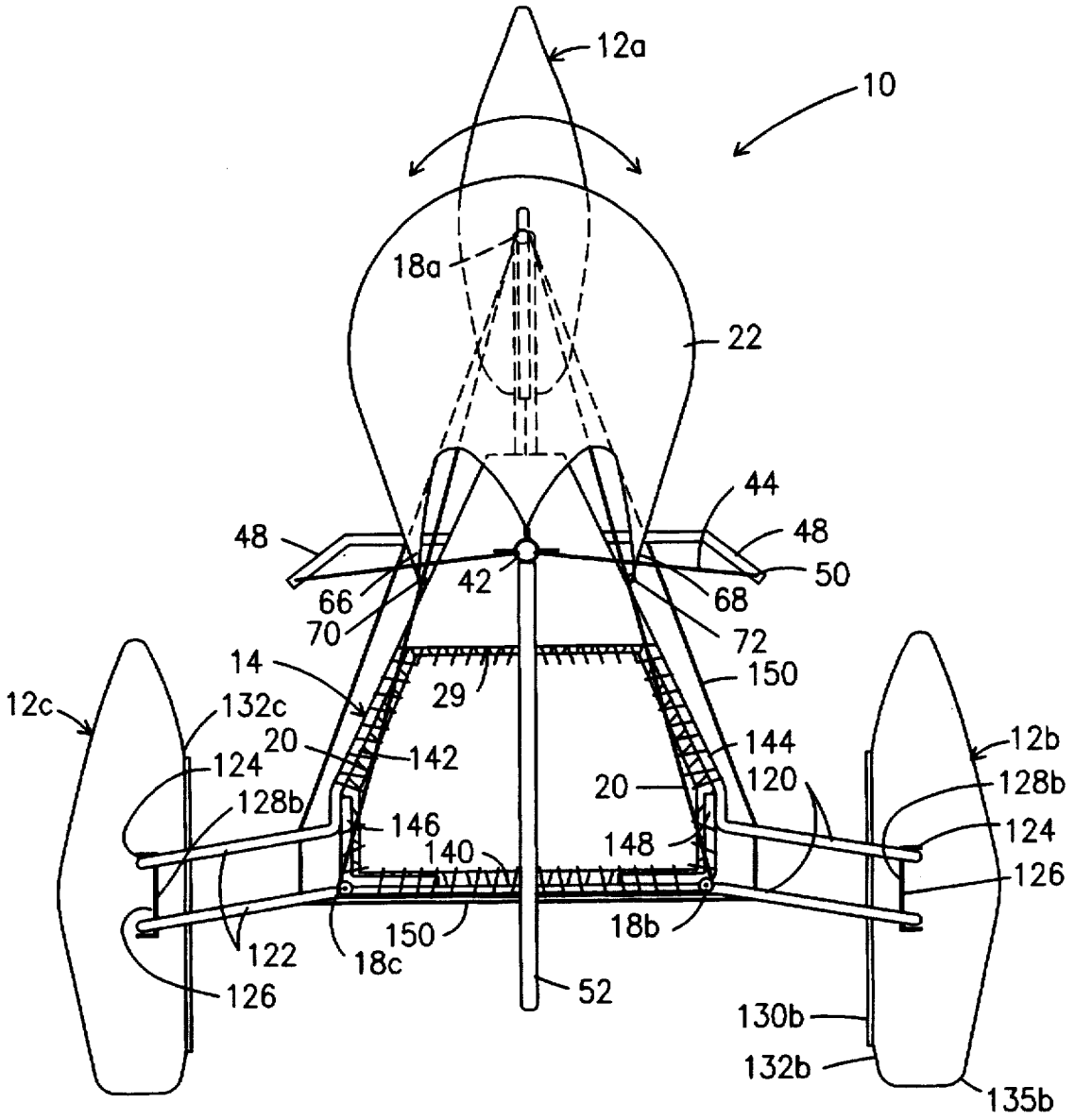
FIG. 5 is a top plan view of the invention of FIG. 1, illustrating the jib in an abeam position acting as a spinnaker.

The deck 14 comprises a deck frame 26 that supports a deck surface 28. The deck frame 26 may be constructed from aluminum tubing and the deck surface 28 may be stretched canvas that is attached to the tubing by line passing through an eyelet in the deck surface 28, around the tubing of the deck frame 26, through the next eyelet in the deck surface 28, and so forth, as shown in FIGS. 1 and 5. By this method, the deck surface 28 may be stretched tautly between the tubes of the deck frame 26. In this embodiment, the deck frame is generally triangular in shape with the apex of the triangle comprising a mast stay plate 29. The apex of the triangle is defined as a bow portion 30. The portion of the deck 14 opposite the bow portion 30 is defined as the stern portion 32. The deck 14 further comprises a bow member 34 that has a first end 36 which is attached to the mast stay plate 29 of the deck 14, and a second end 38 that extends outwardly and generally downwardly therefrom. The second end 38 of the bow member 34 is connected to sponson 12*a*, that is defined as the bow sponson. The mast stay plate 29 of the deck 14 is comprised of a aluminum plate for increased structural strength. The first end 40 of the mast 16 is attached to the mast stay plate 29 by steel angles and bolts or any other well known means. The second end 42 of the mast 16 extends upwardly therefrom. The mast 16 may be constructed from fiberglass, wood, metal or any other material that is suitable for the purpose. The mast 16 is strengthened by a forward stay 44 that is attached at one end to the bow member 34 and at the other end to the second end 42 of the mast 16. A pair of shroud lines 46 extend downwardly from the second end 42 of the mast 16 and are attached to a spreader bar 48. The spreader bar 48 may be a single tubular bar that extends under and is attached to the mast stay plate 29, by brackets (not shown) bolted, adjacent to the point of attachment of the mast 16. Each end 50 of the spreader bar 48 is bent so 10 that a portion of the spreader bar 48 extends aft to provide additional angular support to the mast 16. This places the shrouds 46 just aft of the mast 16 and permits free movement of the boom 52 to sweep a wide angle, close to 180 degrees, enabling the mainsail 54 to receive a following wind.

Figure 4:
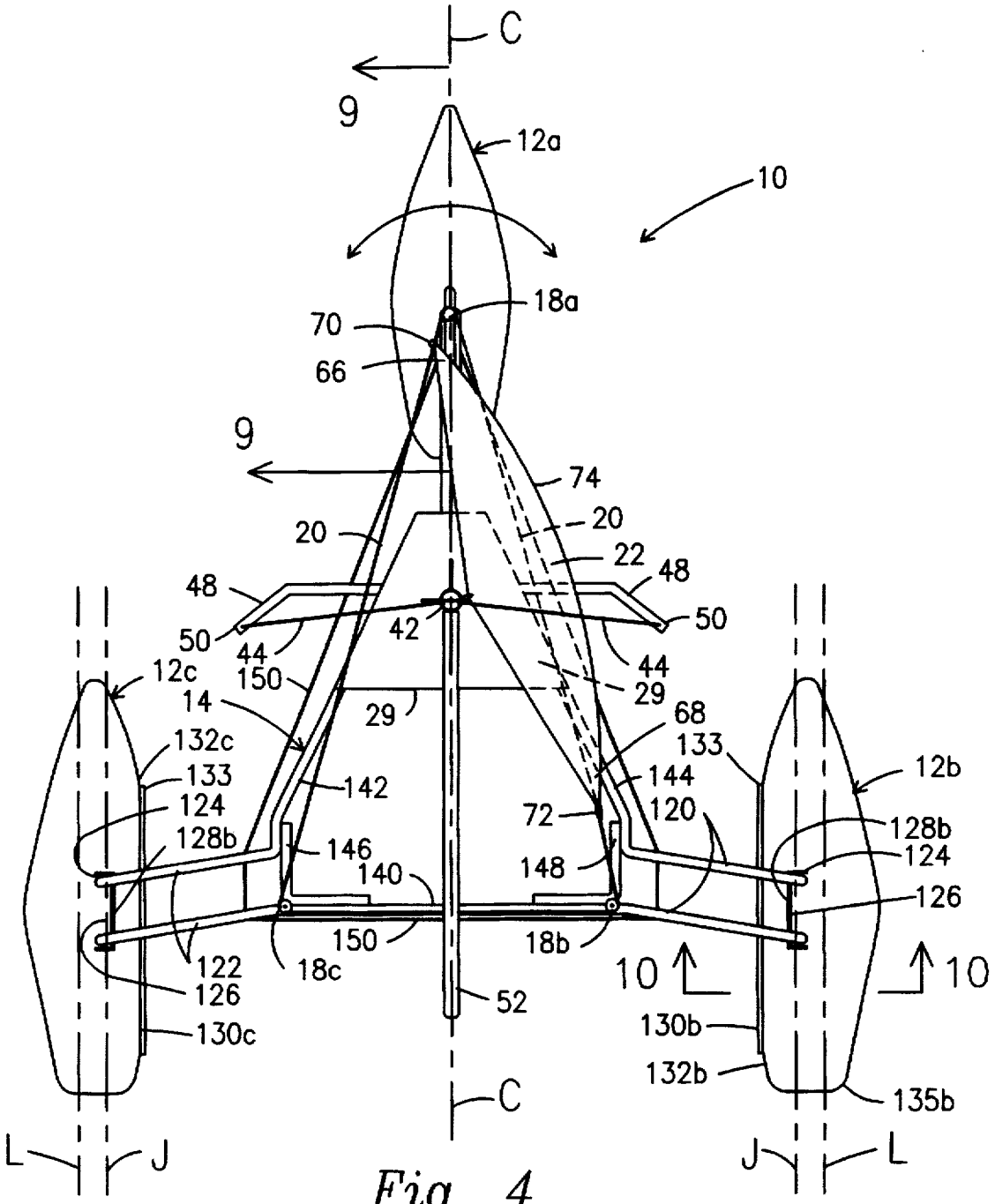
FIG. 4 is a top plan view of the invention of FIG. 1, illustrating the jib in the starboard position.

A first guide 18*a* is attached to the deck 14 proximal to the bow portion 30. A pair of guides 18*b* and 18*c* are connected to the deck 14 proximal the stern portion 32 so that the pair of guides 18*b* and 18*c* are spaced apart from one another. The two ends of a line 20 are attached to one another to form a loop that movably engages the first guide 18*a* and each guide of the pair of guides 18*b* and 18*c*. The loop of line 20 is stretched tightly to maintain contact with each of the guides 18*a–c*. The sail, defined as a jib 22, has a head portion 64, a first lower corner portion, defined as a first clew 66 and a second lower corner portion, defined as a second clew 68. The first clew 66 is attached to the line 20 at a first attachment point 70 and the second clew 68 is attached to the line 20 at a second attachment point 72, which can be seen most clearly in FIG. 4. The first attachment point 70 and the second attachment point 72 are spaced apart from one another so that the foot 74 of the jib 22 remains generally taut. The head portion 64 of the jib 22 is pivotally attached to the mast 16, usually proximal to the second end 42 of the mast. Movement of the line 20 through the first guide 18*a* and the pair of guides 18*b* and 18*c*, causes the first clew 66 and the second clew 68 to move with the line 20 changing the orientation of the jib 22 in relation to the sailboat 10 and also in relation to the wind. FIG. 4 illustrates the jib 22 aligned along the starboard side of the sailboat 10. FIG. 5 illustrates the first attachment point 70 and the second attachment point 72 being abeam of one another so that the sail bellies out over the bow portion 30 to act as a spinnaker. The spinnaker configuration is used when sailing before the wind, when the wind comes over the stern portion 32 of the sailboat 10. Making small movements of the line 20 will make small adjustments in the orientation of the jib 22, to better catch a wind that is coming from within either quarter, within 45 degrees to port or starboard from directly astern. By continuing to move the line 20 in a counter-clockwise direction, as viewed from above, the jib 22 can be positioned along the port side of the sailboat 10, a mirror image, along axis C, of the position of the jib 22 shown in FIG. 4.

The guides 18*a–c*, in a preferred embodiment, are comprised of sheaves which may be set in a block as a standard pulley, or may remain without a block for free movement of the attachment points 70 and 72 through the guides 18*a*, 18*b* and 18*c*. In other embodiments the guides may be simple grooves formed in a block of material or may be constructed in any manner that captures the line 20 and yet permits movement of the line 20 about the deck 14. If the structure of the guides will not permit the attachment point 70 and 72 to pass through the guides 18*a*, 18*b* and 18*c*, it is essential that the first clew 66 be attached to a portion of the line 20 that extends between the first guide 18*a* and one of the pair of guides 18*b* and 18*c*, and the second clew 68 be attached to a portion of the line extending between the first guide 18*a* and the other one of the pair of guides 18*b* and 18*c*. Attachment in this manner will ensure that the jib 22 can extend along either the port or the starboard side of the sailboat 10.

The first and second clew 66 and 68 may be attached to the line 20 by any well known means. Those skilled in the art will understand how to attach a short line to a grommet in a sail and how to attach the other end of a short line to a second line such as line 20. The line 20 may be comprised of woven nylon or polyurethane or a blend that is sufficiently strong and suitable for use on sailboat or line 20 may be a woven steel cable. In the embodiment of FIG. 1 the deck 14 further comprises a bow sprint 76 that is attached to the bow member 34 and extends forward and outwardly from the deck 14. The first guide 18*a* is attached to the bow sprint 76 to permit the use of a jib 22 that has a longer foot 74 than if the first guide 18*a* a were attached to the deck 14 closer to the mast 16. The pair of guides 18*b* and 18*c* are connected proximal to the deck 14, but in other embodiments they may be attached to struts (not shown) that extend outwardly from the deck 14 to increase the spacing between the guides 18*b* and 18*c*, normal to the longitudinal axis C. Increasing this spacing permits the use of a jib 22 having a longer foot 74, will provide a different angle that the jib makes with the deck 14 and the mainsail 54 and will increase the amount of sail that jib 22 can present to the wind, when the jib 22 is acting as a spinnaker. Only three guides 18*a–c* have been illustrated; however additional guides may be provided to guide the line 20 about the deck 14 and ensure ease of operation.

Figure 8:
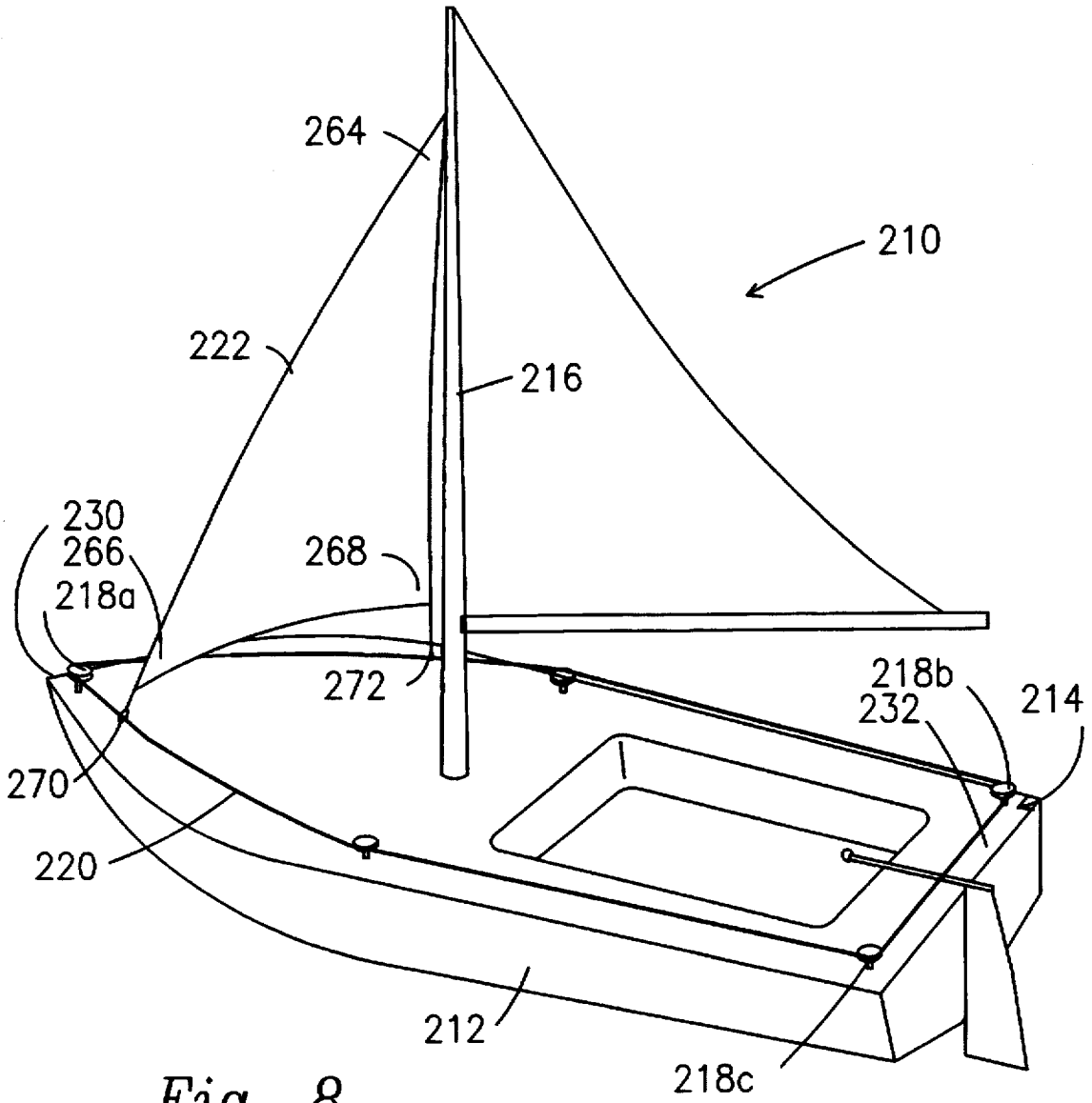
FIG. 8 is a isometric view of a second embodiment of the sailboat having a single hull.

In a second embodiment illustrated in FIG. 8, the sailboat comprises a single hull 212 to which a deck 214 is attached. A first guide 218*a* is attached to the deck 214 proximal the bow portion 230 and a pair of guides 218*b* and 218*c* are attached to the deck 214 proximal the stern portion 232 so that the pair of guides 218*b* and 218*c* are spaced apart from one another. As in the first embodiment, the sail, defined as a jib 222, has a head portion 264 that is pivotally attached to the mast 216 proximal to the second end 242 of the mast 216. The first lower corner, defined as the first clew 266 is attached to the line 220 at the first attachment point 270. The second lower corner, defined as the second clew 268 is attached to the line 220 at the second attachment point 272. In the second embodiment illustrated, when pulling on the line 220 so that it moves in a counterclockwise direction, when viewed from above, the lower portion of the jib 222, the foot 274, will move with the line 220 so that the jib 222 is presented to the wind at different angles. When a new course is set the jib 222 may be adjusted by pulling on line 220 so that the jib 222 more efficiently catches the wind.

Figure 6:
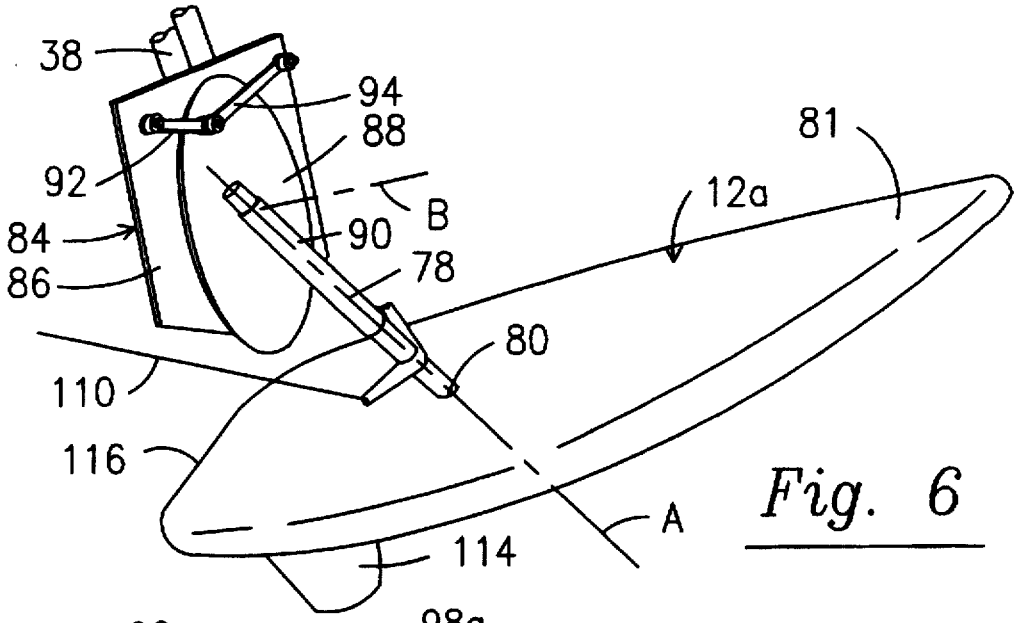
FIG. 6 is a detail view of the bow sponson of the invention of FIG. 1.
Figure 7:
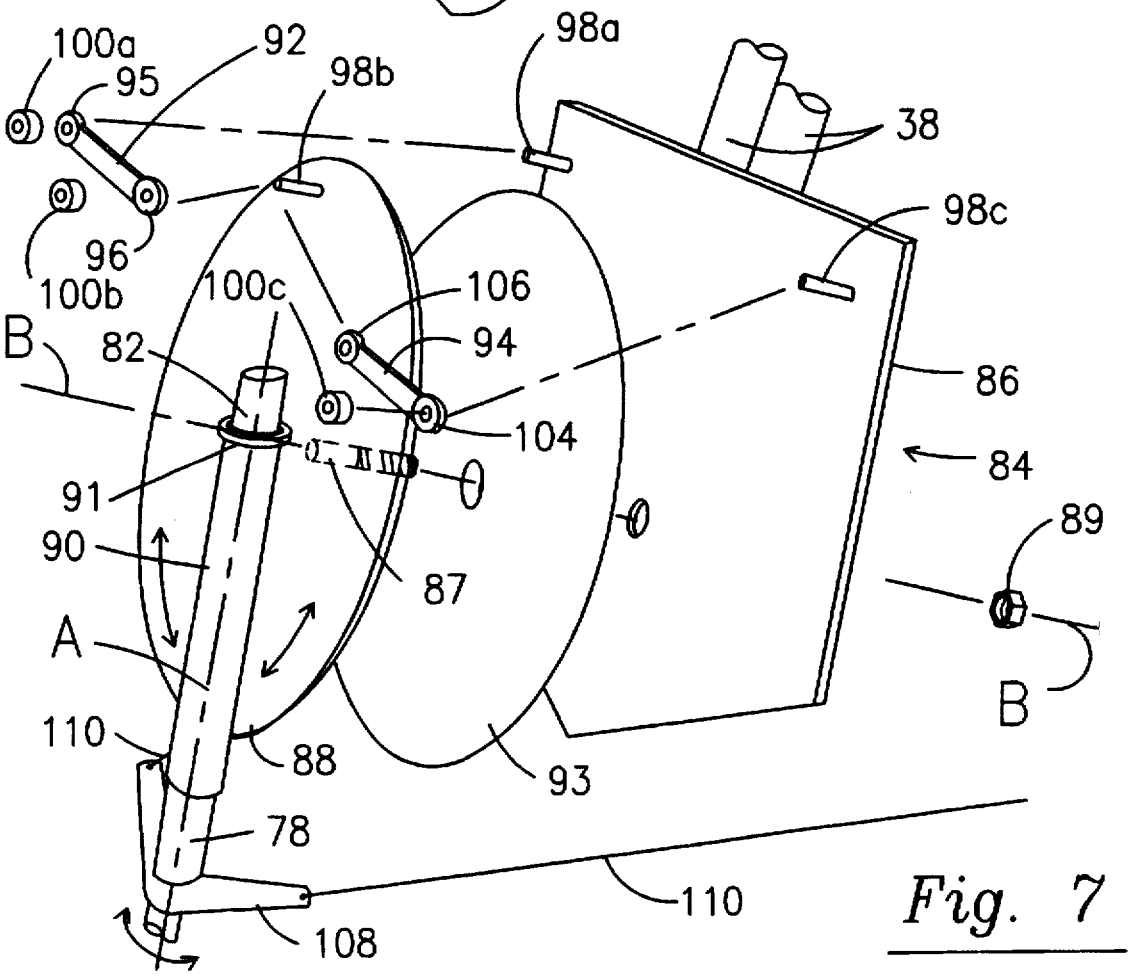
FIG. 7 is a detailed view of the connector that attaches the bow sponson to the deck.

In the embodiment disclosed in FIGS. 1–7, 9 and 10, and as seen in FIG. 6, the bow sponson 12*a* has a post 78 that has a first end 80 that is attached to the top surface 81 of bow sponson 12*a* and a second end 82 that extends outwardly therefrom. As seen in FIG. 6 and 7, a connector 84 attaches the bow sponson 12*a* to the deck 14 for pivotal movement of the bow sponson 12*a*. In a preferred embodiment connector 84 comprises a first plate 86 that is attached to the second end 38 of the bow member 34. A second plate 88 is pivotally attached by bolt 87 and lock nut 89 to the first plate 86 for pivoting about an axis B that is normal to plate 88 and extends longitudinally through the center of rotation of the bolt 87. A sleeve 90 is attached to the second plate and is sized and configured to receive the first end 82 of the post 78 therethrough. The sleeve 90 is positioned on the second plate 88 so that the axis A that extends through the post 78 passes through the axis B. The post 87 is attached to the sleeve by a C-clip 91, lock nut, or any other well known means to prevent the post 78 from sliding out of the sleeve 90. The sponson 12*a* is now free to rotate about two axes, axis A by rotation of the post 78 within the sleeve 90 and about axis B by rotation of the second plate 88, about the bolt 87. In a preferred embodiment, for ease of operation a third plate 93, made from a slick material such as TEFLON®, is inserted between the first plate 86 and the second plate 88 to permit free movement between the first plate 86 and the second plate 88. In other embodiments a coating of slick material may be applied to the sides of first plate 86 and second plate 88 that would engage each other. As it is undesirable for the bow sponson 12*a* to over rotate about axis B, a biasing means is attached to the first plate 86 and the second plate 88 to restrict the rotational movement between a first position and a second position. The biasing means conveniently comprises a first elastic band 92 and a second elastic band 94 that are each pivotally attached to the first plate 86 and the second plate 88. The first end 95 of the first elastic band 92 is mounted on a stud 98*a* on the first plate 86 and is held on the stud by a fastener 100*a*, which is threadably attached to the stud 98*a*. The first end 104 of the second elastic band 94 is attached to stud 98*c* by fastener 100*c* on the first plate 86 in the same manner. The second end 96 of the first elastic band 92 and the second end 106 of the second elastic band 94 are both mounted on the stud 98*b* that is attached to second plate 88 and are attached thereto by fastener 100*b*. In all cases the fasteners 100*a–c* are attached sufficiently loosely to allow the elastic bands 92 and 94 to pivot about the respective studs 98*a–c*. As the second plate 88 rotates about the bolt 87 in a clockwise manner the first elastic band 92 increasingly resists the rotational movement until the plate 88 cannot rotate any further in that direction, defined as a first position. As the second plate 88 rotates in the counterclockwise direction the second elastic band 94 increasingly resists rotation until a maximum rotation is reached, defined as a second position. As the plate moves from the first position to the second position it passes through a mid-position where the sponson is horizontal to the water surface and a plane passing through axis A of the post 78 is generally perpendicular to the water surface. The elastic bands 92 and 94 in a preferred embodiment, are similar in construction to bungee cords and have a resistance strength that will be determined by those skilled in the art based upon the size and weight of the sailboat. The elastic bands 92 and 94 should be strong enough to limit the pivoting action so that it does not exceed 75 degrees from the first position to the second position. Different elastic bands 92 and 94 with different stretch characteristics may be substituted to change the maximum degrees of pivot, between the first position and the second position. Reducing the degrees of pivot that is permitted may be necessary depending upon the roughness of the sea conditions or upon the expected use, ie. cruising versus racing a tight course. The elastic bands 92 and 94, are but one form that the biasing means may take. In other preferred embodiments, the biasing means may comprise springs and levers or any other well known means for limiting the pivoting action between the first plate 86 and second plate 88.

A "V" shaped arm 108 is attached to the post 78 and a control wire 110 is attached to each end of the arm 108 for pivotal movement of the post 78 about its axis A and thus pivotal movement of the entire bow sponson 12*a*. Pivoting the bow sponson 12*a* about axis A to the starboard or port causes the sailboat to turn in that direction. The control wire 110 extends from the arm 108 to the stern portion 32 of the sailboat 10 where it is attached to a tiller 112 for easy control by a single sailor. A rudder 114 extends downwardly from the bottom surface 115 of the bow sponson 12*a* proximal to the stern 116 of the bow sponson 12*a* for improved turning characteristics.

Figure 9:
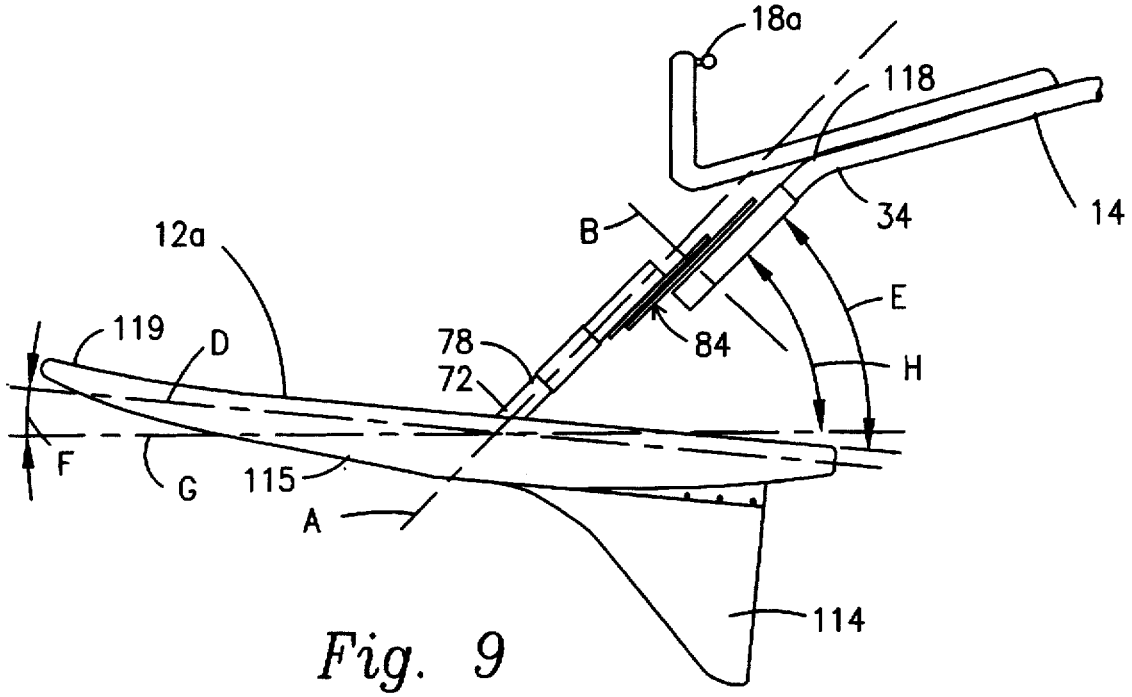
FIG. 9 is a detailed cross-sectional view taken along 9—9 of FIG. 4.

The angle at which the post 78 is attached to the bow sponson 12*a* is important in determining the handling characteristics of the sailboat 10. When the sailboat 10 is placed on a flat body of water with the tiller 112 on center, so the rudder lies perfectly straight and the sailboat 10 would move directly forward, the sailboat 10 is basically symmetrical about its longitudinal axis C, disregarding the jib 22. FIG. 9 is a partial cross sectional view of the sailboat 10 as shown in FIG. 4 along the longitudinal or symmetrical axis C of the sailboat 10. It can be seen in FIG. 9 that the axis A of the post 78 forms an angle E with the longitudinal axis D of the bow sponson 12*a*. Angle E, in a preferred embodiment, is 50 degrees, but angle E may lie in the range of 30 degrees to and including 60 degrees and still maintain steering efficiency. A bend 118 is formed in the bow member 34 to create the angle between the post and the sponson and to provide a tilt to the axis D of the bow sponson 12*a* so that the bow 119 of the bow sponson 12*a* is angled upwardly. An angle F is formed between the axis D of the sponson 12*a* and a plane G that passes through the second end 72 of the post 78 and is parallel to the surface of the water. Angle F is preferably 5 degrees and lies within the range of 2 to 8 degrees. Therefore, angle H, the angle formed between the axis A of the post 78 and the horizontal plane G is preferably 45 degrees, but angle H may lie within the range of 22 degrees to 58 degrees. The upward tilt of the bow of the sponson 12*a*, is to aid the sponson 12*a* in achieving a planing attitude with the water surface in order to reduce the frictional resistance between the sponson 12*a* and the surface of the water.

Figure 10:
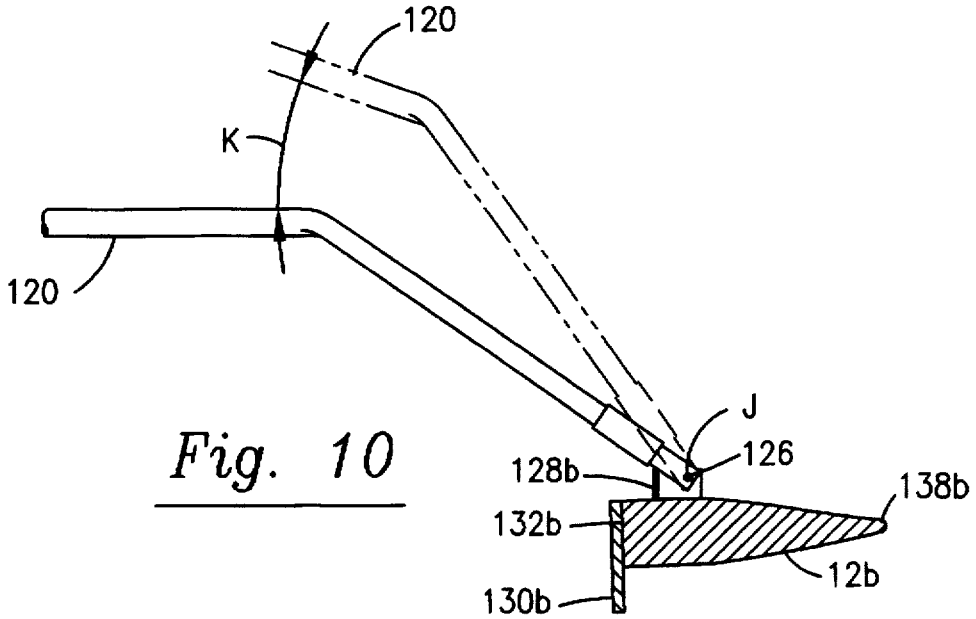
FIG. 10 is a detailed cross-sectional view taken along 10—10 of FIG. 4.

The deck frame 26, as shown in FIG. 4, includes two pair of legs, one pair of legs 120 extending outwardly from the starboard and the second pair 122 extending outwardly from the port side of the sailboat 10. Each pair of legs 120 and 122 is connected to a respective sponson 12*b* and 12*c*, which are defined as the stern sponsons of the sailboat 10. Each pair of legs is attached to its respective sponson by a bracket 124 that includes a shaft 126 upon which the legs are pivotally mounted, as shown in FIG. 10. A bar 128 extends parallel to the shaft 126 on the interior side of the legs 120 and 122 to provide a stop that prevents the sponsons 12*b* and 12*c* from rotating inwardly beyond the horizontal. The sponson is free to rotate in a counter-clockwise direction, when viewed from the stern 135, up to approximately 33 degrees, about axis J that extends through the shaft 126. When the wind pressure against the sails 22 and 54 causes the sailboat 10 to rise up onto the bow sponson 12*a* and one of the stern sponsons, for example sponson 12*b* as shown in FIG. 10, the starboard leg 120 pivots around axis J of the shaft 126 through an angle K, permitting the sponson 12*b* to remain generally horizontal so that the bottom surface 134*b* retains full contact with the water surface. The maximum desirable angle of rotation K normally reached during sailing is approximately 33 degrees, as any increase above 33 degrees reduces the amount of sail surface presented by the sailboat 10 to the wind, reducing the efficiency of the sails and slowing the sailboat 10. The bracket 124 and axis J is positioned inboard of the center of gravity of the stern sponsons as shown in FIG. 4. The extra weight outboard of the axis J will cause the stern sponsons, when out of the water, to freely rotate about axis J until the legs 120 or 122 engage the respective bar 128*b*, and 128*c*, so that the sponsons 12*b* and 12*c* are generally horizontal with the water. Each stern sponson 12*b* and 12*c* includes a skeg 130*b* and 130*c* respectively. The skegs are attached to the inboard edge 132*b* and *c* of the respective sponsons as shown in FIGS. 4 and 10. The skegs 130*b* and 130*c* are tapered so that the forward end 133 of each skeg is flush with the bottom surface 134 of the sponson. Each skeg 130*b* and 130*c* extends in the range of five ninths to and including seven ninths of the length of the respective stern sponsons 12*b* and 12*c* as measured from the stern 135*b* and 135*c* of the sponsons. It is important that the skegs extend forward far enough so that there is sufficient lateral area to reduce lateral movement of the sailboat. Tapering the skegs provides a better balance between improved steering characteristics and resistance of the sailboat 10 to side slippage. By tapering the skegs 130*b* and 130*c*, a greater portion of the vertical area of the skegs is placed toward the stern 135*b* and 135*c* of the sponsons, which moves the vertical pivot point of the sponson about the skeg toward the rear of the sponson. Having the pivot point of the rear sponsons proximal to the stern improves the turning characteristics of the vessel by providing an increased mechanical advantage to the bow rudder 114. However, the tapered skegs 130*b* and 130*c* still provide excellent resistance to sideward slippage of the sailboat 10 due to lateral forces that are applied to the sailboat 10 by the wind or by wave action.

Figure 3:
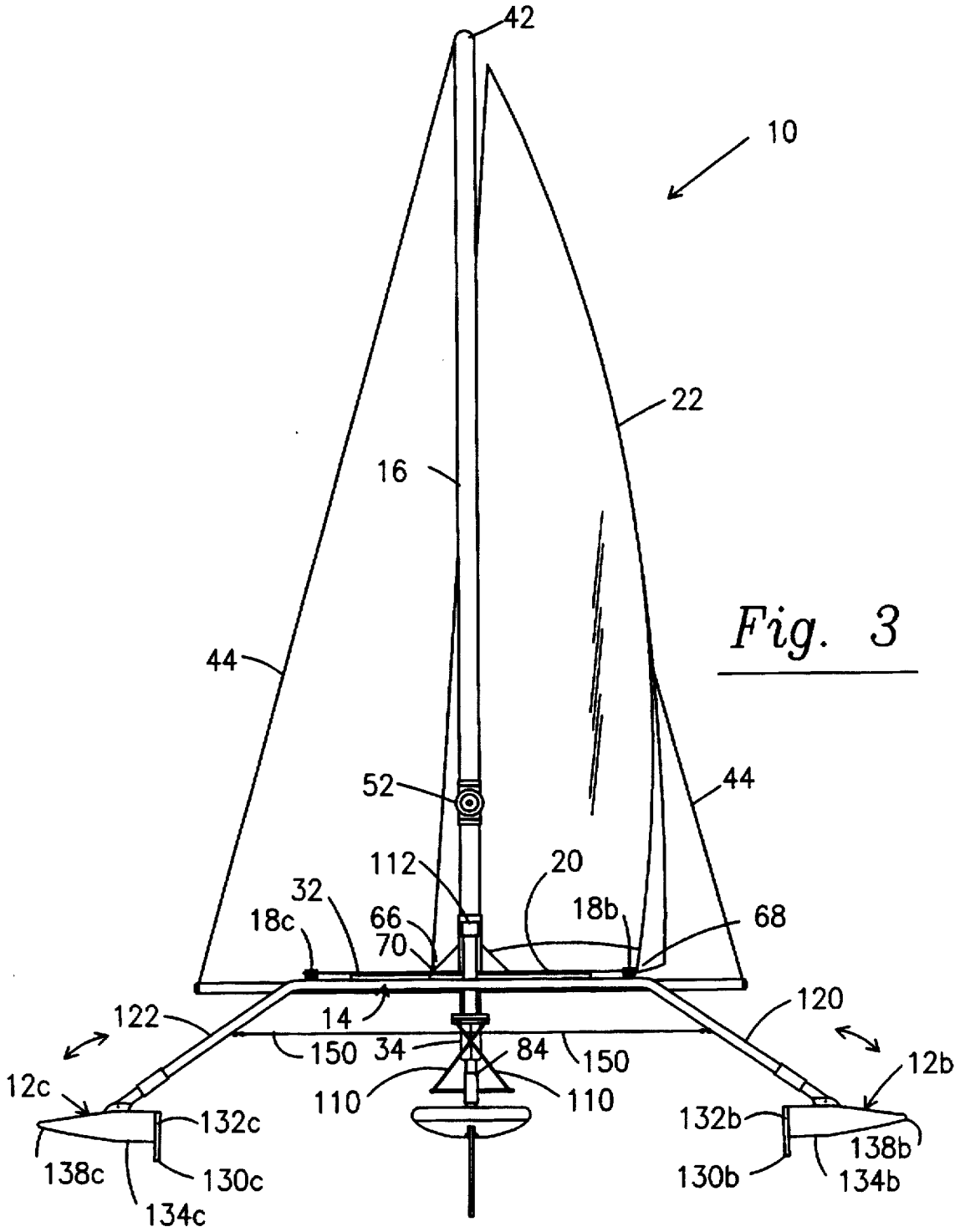
FIG. 3 is a rear elevational view of the invention of FIG. 1.

As shown in FIGS. 3 and 10, the thickness of the stern sponsons is greater on the inboard edge 132*b* and 132*c* than on the outboard edge 138*b* and 138*c*. Each of the rear sponsons has a slightly convex bottom surface 134*b* and 134*c* and the longitudinal axis of each stern sponson 12*b* and 12*c* is angled upwardly from 2 to 8 degrees in relation to the water surface, see angle M in FIG. 2. Angle M is similar to the angle F of the bow sponson 12*a*, so that the stern sponsons will also easily and quickly reach a planing attitude, reducing the wetted surface by riding on the bottom surface 134*b* and 134*c* proximal the stern 135*b* and 135*c* of the stern sponsons 12*b* and 12*c*.

By constructing the sailboat 10 from aluminum tubular material, the sailboat 10 is easily disassembled and transported, breaking down into eight major components. In a preferred embodiment, as best seen in FIG. 4, the deck frame 26 is comprised of a generally straight first tube 140 that comprises the stern portion of the frame and one part of each pair of the starboard legs 120 and the port legs 122. A second tube 142 comprises the other part of the port leg 122 and the port side of the deck 14. A third tube 144 comprises the other part of the starboard leg 120 and the starboard side of the deck 14. A fifth tube 146 joins the first tube 140 with the second tube 142 and a sixth tube 148 joins the first tube 140 with the third tube 144. In a preferred embodiment, the tubes of the frame 26 are attached to one another by nuts and bolts, for ease of assembly and disassembly, but in other embodiments the parts may be joined by threaded fittings or a combination of bolts and threaded fittings. In other embodiments the frame may be fixed by welding or other methods that are suitable for the particular material from which the frame is constructed. One end of the tubes 142 and 144 are attached to a yoke, not shown, on the under side of the mast stay plate 29 by bolts, not shown. The first end 36 of the bow member, which is comprised of two tubes, is attached to the mast stay plate 29 in the same manner. In other embodiments the frame may be constructed from any suitable material and may be divided into different part configurations. A major consideration, is keeping the sailboat 10 strong but still light and easy for one person to handle.

Tensioning cables 150 extend between the legs 120 and 122 and between each leg and the bow member 34. These cables 136 are attached approximately midway up the legs 120 and 122 of the stern sponsons and midway up the bow member 34 to provide additional strength to the frame 14 to prevent the legs from bending outwardly. In a preferred embodiment, the cables 150 are constructed from 3/16 inch, 1,000 lb. high tensile, woven, stranded, stainless steel.

In other embodiments, the sponsons may be replaced with wheel assemblies for use on the land and blade assemblies for use on ice.

Having thus set forth a preferred construction for the sailboat 10 of this invention, it is to be remembered that this is but a preferred embodiment. Attention is now invited to a description of the use of the sailboat 10. With the sailboat 10 rigged as shown in FIG. 1 it is ready for sailing on a port tack where the wind comes across the port side of the sailboat 10. When wind gusts or the wind velocity increases the pressure against the sail the mast will tilt to the starboard lifting the port stern sponson 12*c* out of the water. As the vessel 10 tilts the bottom 115 of the bow sponson 12*a* and the bottom 134*b* of the stern sponson 12*b* maintains full contact with the water as the vessel rotates about axis b in relation to the bow sponson and axis J in relation to the stern sponson 12*b*. In this attitude, with the bottom 115 of the bow sponson maintaining full contact with the water surface, the sailboat 10 may still be easily steered by rotation of the bow sponson about axis A by movement of the tiller to the port or starboard. The angle to which the bow sponson 12*a* is presented to the water upon turning causes the inside edge, in the direction that the sailboat is being turned, of the bow sponson 12*a* to dig into the water causing the sailboat 10 to turn easily, decreasing the turning radius of the sailboat 10. This action between the sponson and the water is similar to the action of a surf board as it makes quick turns. The reduced resistance provided by the tapered skegs 130*b* and 130*c* also decreases the turning radius and thus increases the responsiveness of the sailboat 10.

For a starboard tack, the sailor pulls on the line 20 in the counterclockwise direction so that the sail moves to the port side and the boom of the main sail 54 moves to the port side so that the wind is now received across the starboard side of the vessel. On the starboard tack the stern sponson 12*b* will frequently be lifted from the water, but the bottom surface of the stern sponson 12*c* and the bow sponson 12*a* will remain in full contact with the water providing continued support for the vessel so that the vessel remains on plane on just the bow sponson 12*a* and the stern sponson 12*c*.

When the sailboat 10 is running before the wind, that is the wind is received over the stern of the sailboat 10, the sailor pulls on the line 20 in a clockwise direction so that the jib 22 moves across the bow portion, as shown in FIG. 5. As the distance between the attachment points 70 and 72 is reduced in this position the jib 22 is fuller and takes on the characteristics of a spinnaker. Depending upon the wind direction, the jib 22 may be moved along the starboard or the port side to increase the percent of the sail that is exposed to the wind. The configuration shown in FIG. 5 would be most effective with the wind coming directly over the stern.

It will thus be seen that the object set forth above, among those made apparent from the preceding description, are efficiently attained and, such certain changes may be made in the above sailboat without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, may be said to fall there between.

Now that the invention has been described,

What is claimed is:

1. A sailboat comprising at least one hull;

a deck connected to said hull, said deck having a bow portion and a stern portion;

a mast having a first end and a second end, said first end being connected to said deck and said second end extending upwardly therefrom;

a first guide connected to said deck proximal said bow portion and a pair of guides connected to said deck proximal said stern portion, said pair of guides being spaced apart from one another;

a line formed in a loop, said line movably engaging said first guide and each guide of said pair of guides; and a sail having a head portion, a first lower corner portion and a second lower corner portion, said head portion being attached to said mast, said first lower corner portion of said sail being attached to said line at a first attachment point, and said second lower corner portion of said sail being attached to said line at a second attachment point, said second attachment point being spaced apart from said first attachment point, whereby movement of said line moves said lower corners of said sail with said line.

2. A sailboat as in claim 1 wherein said first lower corner portion is attached to a portion of said line extending between said first guide and one of said pair of guides, and said second lower corner portion being attached to a portion of said line that extends between said first guide and the other one of said pair of guides.

3. A sailboat as in claim 1 comprising three hulls, each hull being connected to said deck, one of said three hulls being defined as a bow sponson, and a connector attaching said bow sponson to said deck for movement of said bow sponson about a first axis and about a second axis.

4. A sailboat as in claim 3 wherein said bow sponson further comprises a post, said post having a longitudinal axis defined as said first axis, a first end attached to said bow sponson, and a second end extending outwardly therefrom, said first end of said post being pivotally attached to said connector for movement of said bow sponson about said first axis, and said connector having an axis therethrough, defined as said second axis, said first end of said post being pivotally attached to said connector for movement of said bow sponson about said second axis.

5. A sailboat as in claim 4 wherein said first and second axes lie in the same plane and are generally at right angles to one another.

6. A sailboat as in claim 3 wherein said bow sponson further comprises a post, said post having a first end attached to said bow sponson, a second end extending outwardly therefrom, and a longitudinal axis, defined as said first axis, said first axis forming an angle with a horizontal plane passing through said first end of said post, said angle lying within a range of 22 degrees to and including 58 degrees.

7. A sailboat as in claim 3 wherein said deck comprises a deck frame supporting a deck surface and a bow member, said bow member having a first end attached to said deck frame and a second end attached to said connector, said connector comprising a first plate attached to said second end of said bow member, a second plate pivotally attached to said first plate for movement about a second axis perpendicular to said second plate, from a first position, through a mid-position and to a second position, a sleeve attached to said second plate, said bow sponson comprising a top surface and a post having a longitudinal axis therethrough defined as said first axis, said post having a first end attached to said top surface of said bow sponson and a second end extending outwardly therefrom, said second end of said post being received by said sleeve for pivoting movement of said post about said first axis, said sleeve being attached to said second plate such that said first and said second axes lie in the same plane and are generally at right angles to one another.

8. A sailboat as in claim 7, said connector further comprising a pair of biasing means, each having a first end attached to said first plate and a second end attached to said second plate such that when said second plate rotates toward said first position one of said pair of biasing means urges said second plate toward said mid-position and when said second plate rotates toward said second position the other one of said pair of biasing means urges said second plate toward said mid-position.

9. A sailboat as in claim 1 further comprising three hulls, each being attached to said deck, one of said three hulls being defined as a port sponson, and another one of said three hulls being defined as a starboard sponson, said port and starboard sponsons each having a longitudinal axis therethrough, said sailboat further comprising a port and a starboard coupler attaching a corresponding one of said port and starboard sponsons to said deck for movement of said port and starboard sponsons about their respective coupler axes that are generally parallel to the respective port and starboard sponson axis.

10. A sailboat as in claim 1 further comprising;

three hulls attached to said deck, one of said three hulls being defined as a port sponson, and another one of said three hulls being defined as a starboard sponson, said port sponson and said starboard sponson each having a bottom surface; and a first skeg attached to said port sponson and a second skeg attached to said starboard sponson, each skeg having a bottom edge with a first end and a second end, said bottom edge of each skeg being tapered so that said first end is flush with the adjacent said bottom surface of the respective said hull and said second end of each skeg extends downwardly from its respective sponson away from said bottom of said port and starboard sponsons, said sponsons each having a stern and said skegs extending forward from said stern so that said second end of said skegs lie within the range of five ninths to seven ninths of the total length of the sponson from the stern.

11. A sailboat as in claim 1 wherein said guides comprise sheaves.

12. A sailboat comprising a deck having a bow portion, a stern portion, a starboard side and a port side;

a mast having a first end and a second end, said first end being connected to said deck and said second end extending upwardly therefrom;

three longitudinally extending hulls being attached to said deck, each of said hulls having a top surface and one of said three hulls being defined as a bow sponson;

a connector attached to said deck; and said bow sponson comprising a post, said post having a longitudinal axis defined as a first axis, a first end attached to said top surface of said bow sponson, and a second end extending outwardly therefrom, said second end of said post being pivotally attached to said connector for movement of said bow sponson about said first axis, and said connector having an axis therethrough, defined as a second axis, said first end of said post being pivotally attached to said connector for movement of said bow sponson about said second axis such that said first and said second axes lie in the same plane and are generally at right angles to one another.

13. A sailboat as in claim 12 wherein said first axis forms an angle with a horizontal plane passing through said first end of said post, said angle lying within a range of 22 to and including 58 degrees.

14. A sailboat as in claim 12, said connector comprising:

a first plate attached to said deck, a second plate pivotally attached to said first plate for movement about said second axis, from a first position, through a mid-position to a second position;

a sleeve attached to said second plate, said sleeve receiving said second end of said post therein for pivoting movement of said post about said first axis.

15. A sailboat as in claim 14, said connector further comprising a pair of biasing means, each having a first end attached to said first plate and a second end attached to said second plate such that when said second plate pivots toward said first position one of said pair of biasing means urges said second plate toward said mid-position and when said second plate pivots toward said second position the other one of said pair of biasing means urges said second plate toward said mid-position.

16. A sailboat as in claim 12 wherein one of said three hulls is defined as a port sponson, and another one of said three hulls is defined as a starboard sponson, said port and starboard sponsons each having a longitudinal axis therethrough, said sailboat further comprising a port and a starboard coupler attaching a corresponding one of said port and starboard sponsons to said deck for movement of said port and starboard sponsons about their respective port and starboard coupler axes, said port and starboard axes are generally parallel to the respective port and starboard sponson axis.

17. A sailboat as in claim 12 wherein one of said three hulls is defined as a port sponson, and another one of said three hulls is defined as a starboard sponson, said port sponson and said starboard sponson each having a bottom surface;

a first skeg attached to said port sponson and a second skeg attached to said starboard sponson, each skeg having a bottom edge with a first end and a second end, said bottom edge of each skeg being tapered so that said first end is flush with the adjacent said bottom surface of the respective said hull and said second end of each skeg extends downwardly away from said bottom of its respective sponson, said sponsons each having a stern and said skegs extending forward from said stern so that said second end of said skegs lie within the range of five ninths to seven ninths of the total length of the sponson from the stern.

* * * * *